US011414731B2

(12) United States Patent
Kobayashi et al.

(10) Patent No.: US 11,414,731 B2
(45) Date of Patent: Aug. 16, 2022

(54) MIXED POWDER FOR POWDER METALLURGY, SINTERED BODY, AND METHOD FOR PRODUCING SINTERED BODY

(71) Applicant: JFE STEEL CORPORATION, Tokyo (JP)

(72) Inventors: Akio Kobayashi, Tokyo (JP); Naomichi Nakamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 316 days.

(21) Appl. No.: 16/482,120

(22) PCT Filed: Jan. 26, 2018

(86) PCT No.: PCT/JP2018/002495
§ 371 (c)(1),
(2) Date: Jul. 30, 2019

(87) PCT Pub. No.: WO2018/143088
PCT Pub. Date: Aug. 9, 2018

(65) Prior Publication Data

US 2019/0390308 A1 Dec. 26, 2019

(30) Foreign Application Priority Data

Feb. 2, 2017 (JP) ..... JP2017-017878
Dec. 27, 2017 (JP) ..... JP2017-251991

(51) Int. Cl.

| | |
|---|---|
| ***C22C 33/02*** | (2006.01) |
| ***B22F 3/10*** | (2006.01) |
| ***C22C 38/02*** | (2006.01) |
| ***C22C 38/04*** | (2006.01) |
| ***C22C 38/12*** | (2006.01) |
| ***B22F 1/10*** | (2022.01) |

(52) U.S. Cl.
CPC ..... *C22C 33/0207* (2013.01); *B22F 1/10* (2022.01); *B22F 3/10* (2013.01); *C22C 38/02* (2013.01); *C22C 38/04* (2013.01); *C22C 38/12* (2013.01); *B22F 2301/10* (2013.01); *B22F 2301/35* (2013.01); *B22F 2302/40* (2013.01)

(58) Field of Classification Search
CPC ..... C22C 33/0207; C22C 38/02; C22C 38/04; C22C 38/12; B22F 1/10; B22F 3/10; B22F 2301/10; B22F 2301/35; B22F 2302/40
See application file for complete search history.

(56) References Cited

U.S. PATENT DOCUMENTS

| | | | | |
|---|---|---|---|---|
| 5,080,712 | A | 1/1992 | James et al. | |
| 6,610,120 | B2 | 8/2003 | Nakamura et al. | |
| 6,758,882 | B2 | 7/2004 | Nakamura et al. | |
| 7,347,884 | B2 | 3/2008 | Unami et al. | |
| 10,207,328 | B2 | 2/2019 | Takashita et al. | |
| 10,265,766 | B2 | 4/2019 | Maetani et al. | |
| 2002/0029657 | A1* | 3/2002 | Uenosono | B22F 1/0059 75/252 |
| 2019/0351483 | A1* | 11/2019 | Kobayashi | B22F 1/0059 |

FOREIGN PATENT DOCUMENTS

| | | | | |
|---|---|---|---|---|
| CN | 103008649 | A * | 4/2013 | |
| CN | 103008649 | A | 4/2013 | |
| CN | 105263653 | A | 1/2016 | |
| JP | S6479303 | A | 3/1989 | |
| JP | 01104701 | A * | 4/1989 | H01L 21/316 |
| JP | H01104701 | A | 4/1989 | |
| JP | H04231404 | A | 8/1992 | |
| JP | 2002146403 | A | 5/2002 | |
| JP | 3475545 | B2 | 12/2003 | |
| JP | 4371003 | B2 | 11/2009 | |
| JP | 2014237878 | A | 12/2014 | |
| JP | 2016108651 | A | 6/2016 | |

OTHER PUBLICATIONS

CN-103008649-A machine translation (Year: 2021).*
JP-01104701-A machine translation (Year: 2021).*
JFE ("Reduced Iron Powders Atomized Iron and Steel Powders", Mar. 24, 2012) (Year: 2012).*
JFE ("Reduced Iron Powders Atomized Iron and Steel Powders", Mar. 24, 2012) wayback machine screen shot (Year: 2021).*
Sep. 8, 2020, Office Action issued by the Korean Intellectual Property Office in the corresponding Korean Patent Application No. 10-2019-7022897 with English language concise statement of relevance.
Jan. 13, 2021, Office Action issued by the China National Intellectual Property Administration in the corresponding Chinese Patent Application No. 201880009127.6 with English language search report.
JFE Steel Corporation, Reduced Iron Powders Atomized Iron and Steel Powders, JFE product catalog, Jan. 2015, Cat. No. J1J-001-03.
Jul. 2, 2019, Notification of Reasons for Refusal issued by the Japan Patent Office in the corresponding Japanese Patent Application No. 2017-251991 with English language Concise Statement of Relevance.

(Continued)

*Primary Examiner* — Robert S Jones, Jr.
*Assistant Examiner* — Jiangtian Xu
(74) *Attorney, Agent, or Firm* — Kenja IP Law PC

(57) ABSTRACT

Disclosed is a mixed powder for powder metallurgy including: (a) an iron-based powder containing Si in an amount of 0 mass % to 0.2 mass % and Mn in an amount of 0 mass % to 0.4 mass %, with the balance being Fe and inevitable impurities; and (b) an alloyed steel powder containing Mo in an amount of 0.3 mass % to 4.5 mass %, Si in an amount of 0 mass % to 0.2 mass %, and Mn in an amount of 0 mass % to 0.4 mass %, with the balance being Fe and inevitable impurities, wherein a ratio of (b) the alloyed steel powder to a total of (a) the iron-based powder and (b) the alloyed steel powder is from 50 mass % to 90 mass %, and a ratio of Mo to the total of (a) the iron-based powder and (b) the alloyed steel powder is 0.20 mass % or more and less than 2.20 mass %.

19 Claims, No Drawings

(56) References Cited

OTHER PUBLICATIONS

Mar. 20, 2018, International Search Report issued in the International Patent Application No. PCT/JP2018/002495.
Jul. 14, 2021, Office Action issued by the China National Intellectual Property Administration in the corresponding Chinese Patent Application No. 201880009127.6 with English language search report.

* cited by examiner

MIXED POWDER FOR POWDER METALLURGY, SINTERED BODY, AND METHOD FOR PRODUCING SINTERED BODY

BACKGROUND

The present disclosure relates to a mixed powder for powder metallurgy, and more particularly to a mixed powder for powder metallurgy having excellent compressibility. The present disclosure also relates to a sintered body using the mixed powder for powder metallurgy and a method for producing the sintered body.

BACKGROUND

Powder metallurgy technology is a method that can form parts with complicated shapes into a shape very close to the product shape (so-called near net shape molding) and enables manufacture with high dimensional accuracy. According to powder metallurgy technology, cutting costs can be significantly reduced. For this reason, powder metallurgical products are used as various mechanical structures and parts thereof in many fields.

Further, in recent years, to achieve miniaturization and reduced weight of parts, an increase in the strength of powder metallurgical products is strongly requested. In particular, there is a strong request for increasing the strength of iron-based press-formed products and iron-based powder sintered products.

In order to meet the demand for higher strength, it has been practiced to add an alloying element having a quench hardenability improving effect to iron-based powder. For example, (1) pre-alloyed steel powder and (2) partially diffusion-alloyed steel powder are known as powders to which alloying elements are added at the stage of raw material powder.

The pre-alloyed steel powder (1) is a powder in which alloying elements are completely alloyed in advance. By using this pre-alloyed steel powder, segregation of alloying elements can be completely prevented, and the structure of the sintered body becomes uniform. As a result, the mechanical characteristics as a press-formed product or a sintered product can be stabilized. However, since complete alloying causes solid solution hardening over the entire powder particles, the compressibility of the powder is low, causing a problem that the forming density is difficult to increase during press forming.

The partially diffusion-alloyed steel powder (2) is a powder in which each alloying element powder is partially adhered and diffused on the surface of pure iron powder or pre-alloyed steel powder. The partially diffusion-alloyed steel powder is prepared by mixing metal powder of alloying elements or its oxide with pure iron powder or pre-alloyed steel powder, and heating under a non-oxidizing or reducing atmosphere to provide diffusion bonding of alloying element powder on the surface of the pure iron powder or pre-alloyed steel powder. With the use of partially diffusion-alloyed steel powder, the structure can be made relatively uniform, the mechanical properties of the product can be stabilized as in the case of using the pre-alloyed steel powder (1). Furthermore, since the partially diffusion-alloyed steel powder has a portion in its inside which contains no or a small amount of alloying elements, it exhibits good compressibility during press forming as compared to the pre-alloyed steel powder (1).

As a basic alloy component to be used for the above pre-alloyed steel powder and partially diffusion-alloyed steel powder, Mo having a quench hardenability improving effect is widely used. In addition to Mo, for example, Mn, Cr, and Si are known as alloying elements having a quench hardenability improving effect. However, among these elements, Mo is relatively hard to oxidize and thus makes production of alloyed steel powder easy. For example, pre-alloyed steel powder can be easily produced by making a molten steel to which Mo is added as an alloying element into a powder with a water atomizing method and subjecting the powder to finish reduction in a normal hydrogen atmosphere. Also, partially diffusion-alloyed steel powder can be easily produced by mixing Mo oxide with pure iron powder or alloyed steel powder and performing finish reduction in a normal hydrogen atmosphere.

As described above, by adding Mo having a quench hardenability improving effect, the formation of ferrite is suppressed and bainite or martensite is generated during hardening treatment, and transformation toughening of the matrix phase is achieved. Furthermore, Mo distributes to the matrix phase to achieve solid solution strengthening of the matrix phase, and forms fine carbides in the matrix phase to achieve strengthening by precipitation of the matrix phase. Mo also has the effect of enhancing carburization because it has a good gas carburizing property and is a non-intergranular-oxidation element.

Examples of alloyed steel powder using Mo are described in, for example, JP4371003B (PTL 1) and JPH04-231404A (PTL 2).

PTL 1 proposes alloyed steel powder in which Mo is further diffusion-bonded to the surface of a pre-alloyed steel powder containing Mo as an alloying element.

PTL 2 proposes applying a twice-forming twice-sintering method when using Mo pre-alloyed steel powder in order to further increase the strength of the sintered body. In the twice-forming twice-sintering method, alloyed steel powder is subjected to forming and pre-sintering, followed by the subsequent forming and main sintering.

CITATION LIST

Patent Literature

PTL 1: JP4371003B
PTL 2: JPH04-231404A

SUMMARY

Technical Problem

However, the demand for increasing the strength of iron-based powder press-formed products and iron-based powder sintered products is becoming increasingly strong, yet the methods proposed in PTLs 1 and 2 can not fully meet the demand. The reason is as follows.

One method for increasing the strength of iron-based powder press-formed products and iron-based powder sintered products is densification. By increasing the density, the rearrangement of iron powder particles proceeds and the void volume ratio inside the formed product decreases, and the area in which the iron powder particles come in contact with each other increases. As a result, iron-based powder press-formed products and iron-based powder sintered products have improved mechanical properties such as tensile strength, impact value, and fatigue strength. In order to increase the density of an iron-based powder sintered product or an iron-based powder press-formed product, the compressibility of the alloyed steel powder, which is a raw material for press forming, may be increased to easily increase the forming density.

Therefore, in PTL 1, partially diffusion-alloyed steel powder is used. As described above, since the partially diffusion-alloyed steel powder has a portion which does not contain alloying elements or has a small amount of alloying elements inside the particles (hereinafter referred to as a "low alloy portion"), it is excellent in the compressibility at the time of press forming compared with pre-alloyed steel powder. It is thought that the compressibility can be further improved by increasing the proportion of the low alloy portion. However, it is necessary to diffusion-bond a certain amount of alloying elements in order to make the characteristics such as quench hardenability within the desired range. Therefore, the proportion of a low alloy portion can not be increased beyond a certain level, and thus sufficient compressibility can not be ensured.

Furthermore, even if the twice-forming twice-sintering method of PTL 2 is applied to the partially diffusion-alloyed steel powder of PTL 1, the diffusion of alloying elements proceeds in the first sintering, the compressibility in the second forming is insufficient, and sufficient compressibility can not be obtained.

It would thus be helpful to provide a mixed powder for powder metallurgy that has higher compressibility than conventional partially diffusion-alloyed steel powder and can obtain high forming density. It would thus also be helpful to provide a sintered body using the mixed powder for powder metallurgy, and a method for producing the same.

Solution to Problem

As a result of conducting studies to solve the above problems, the inventors obtained the following findings.

In the partially diffusion-alloyed steel powder, the source at which high compressibility is developed is a low alloy portion existing inside the particles making up the partially diffusion-alloyed steel powder, that is, a portion containing no alloying element or a small amount of alloying elements. In the low alloy portion, the solid solution strengthening effect exerted by the alloying elements is small, and deformation is easy during press forming. On the contrary, since the alloying elements are diffusion-bonded to the surface of the particles, the concentration of the alloying elements is high and deformation is difficult.

As described above, the partially diffusion-alloyed steel powder has the property that the surface is not easily deformed and the inside is easily deformed. By having such an internal structure of particles, partially diffusion-alloyed steel powder is more likely to undergo rearrangement of particles than pre-alloyed powder, and thus the forming density tends to increase. However, as can be seen from the actual state of forming alloyed steel powder, in order to fill the gaps between the particles and rearrange the particles, it is desirable that the surface of the particles, rather than the inside, is able to be deformed according to the shape of particles present in the periphery.

However, in any of the pre-alloyed steel powder and the partially diffusion-alloyed steel powder, the surface of the particles contains an alloy component, and the surface of the particles can not have such a soft state as described above.

Therefore, the inventors conceived of using a mixture of an iron-based powder not containing Mo and an alloyed steel powder containing Mo, instead of softening the surface of particles. By using a combination of an alloyed steel powder containing Mo and an iron-based powder with low hardness containing no Mo, the compressibility at the time of press forming is improved even in the case of ordinary single forming, and also in the twice-forming twice-sintering method, if the alloying elements diffuse during the first sintering, portions not containing Mo remains sufficiently to maintain high compressibility even in the second forming. However, if the mix proportion of the iron-based powder not containing Mo is too small, such effects become insufficient, and conversely, if it is too large, the mechanical properties are deteriorated.

Based on the above findings, the present disclosure was conceived as a result of various studies on conditions under which both compressibility and mechanical properties can be compatible. In detail, we provide the following:

1. A mixed powder for powder metallurgy comprising: (a) an iron-based powder containing (consisting of) Si in an amount of 0 mass % to 0.2 mass % and Mn in an amount of 0 mass % to 0.4 mass %, with the balance being Fe and inevitable impurities; and (b) an alloyed steel powder containing (consisting of) Mo in an amount of 0.3 mass % to 4.5 mass %, Si in an amount of 0 mass % to 0.2 mass %, and Mn in an amount of 0 mass % to 0.4 mass %, with the balance being Fe and inevitable impurities, wherein a ratio of (b) the alloyed steel powder to a total of (a) the iron-based powder and (b) the alloyed steel powder is from 50 mass % to 90 mass %, and a ratio of Mo to the total of (a) the iron-based powder and (b) the alloyed steel powder is 0.20 mass % or more and less than 2.20 mass %.

2. The mixed powder for powder metallurgy according to 1 above, wherein the ratio of (b) the alloyed steel powder to the total of (a) the iron-based powder and (b) the alloyed steel powder is from 70 mass % to 90 mass %.

3. The mixed powder for powder metallurgy according to 1 or 2 above, further comprising: (c) a Cu powder; and (d) a graphite powder, wherein a ratio of (c) the Cu powder to a total of (a) the iron-based powder, (b) the alloyed steel powder, (c) the Cu powder, and (d) the graphite powder is from 0.5 mass % to 4.0 mass %, and a ratio of (d) the graphite powder to the total of (a) the iron-based powder, (b) the alloyed steel powder, (c) the Cu powder, and (d) the graphite powder is from 0.2 mass % to 1.0 mass %.

4. The mixed powder for powder metallurgy according to 3 above, further comprising: (e) a lubricant, wherein a ratio of (e) the lubricant to the total of (a) the iron-based powder, (b) the alloyed steel powder, (c) the Cu powder, and (d) the graphite powder is from 0.2 mass % to 1.5 mass %.

5. A sintered body obtainable by forming and sintering the mixed powder for powder metallurgy as recited in any one of 1 to 4 above.

6. A method for producing a sintered body, comprising subjecting the mixed powder for powder metallurgy as recited in any one of 1 to 4 above to forming and sintering to obtain a sintered body.

Advantageous Effect

The mixed powder for powder metallurgy disclosed herein is superior in compressibility to the conventional partially diffusion-alloyed steel powder, and it can be used not only in the usual single-forming single-sintering method but also in the twice-forming twice-sintering method to obtain a press-formed product having a high forming density. Moreover, according to the present disclosure, a sintered body having high strength can be obtained.

DETAILED DESCRIPTION

The following describes the present disclosure in detail. In the following description, "%" notation represents "mass %" unless otherwise specified.

The mixed powder for powder metallurgy (hereinafter sometimes simply referred to as "mixed powder") in one of the embodiments disclosed herein contains, as essential components, (a) an iron-based powder and (b) an alloyed steel powder.

(a) Iron-Based Powder

As the iron-based powder, an iron-based metal powder containing Si in an amount of 0% to 0.2% and Mn in an amount of 0% to 0.4%, with the balance being Fe and inevitable impurities, is used. The iron-based powder has an effect of securing the compressibility at the time of press forming by being mixed with (b) the alloyed steel powder. Therefore, it is desirable that the iron-based powder be as soft as possible. If the iron-based powder contains an element other than Fe, the compressibility decreases. Therefore, an iron powder composed of Fe and inevitable impurities (also referred to as "pure iron powder") is preferably used as the iron-based powder.

Note that Si and Mn are contained as impurities in general iron-based powder. Si and Mn are elements having the effect of improving the quench hardenability in addition to the effect of increasing the strength by solid solution strengthening. Therefore, when Si and Mn are contained, the strength of the sintered body may be improved depending on the cooling conditions at the time of sintering the press-formed product and the conditions such as quenching and tempering conditions, and hence these elements may work advantageously in reverse. From the above reasons, the iron-based powder is permitted to contain one or both of Si and Mn in the range described below.

Si: 0% to 0.2%

Si is an element having the effect of increasing the strength of steel by quench hardenability improvement, solid solution strengthening, and the like. However, when the Si content in the iron-based powder exceeds 0.2%, more oxides form and the compressibility decreases, and the oxides become the starting point of fracture in the sintered body, causing the fatigue strength and toughness to decrease. Therefore, the Si content of the iron-based powder is 0.2% or less. On the other hand, as described above, from the viewpoint of compressibility, a lower Si content is preferable. Thus, the Si content may be 0%. Therefore, the Si content of the iron-based powder is 0% or more.

Mn: 0% to 0.4%

Mn, like Si, is also an element having the effect of increasing the strength of steel by quench hardenability improvement, solid solution strengthening, and the like. However, when the Mn content in the iron-based powder exceeds 0.4%, more oxides form and the compressibility decreases, and the oxides become the starting point of fracture in the sintered body, causing the fatigue strength and toughness to decrease. Therefore, the Mn content of the iron-based powder is 0.4% or less. On the other hand, as described above, from the viewpoint of compressibility, a lower Mn content is preferable. Thus, the Mn content may be 0%. Therefore, the Mn content of the iron-based powder is 0% or more.

Although the amount of inevitable impurities (Si and Mn excluded) contained in the iron-based powder is not particularly limited, the total amount is preferably 1.0 mass % or less, more preferably 0.5 mass % or less, and even more preferably 0.3 mass % or less. Among the elements contained as inevitable impurities, the P content is preferably 0.020% or less. The S content is preferably 0.010% or less. The 0 content is preferably 0.20% or less. The N content is preferably 0.0015% or less. The Al content is preferably 0.001% or less. The Mo content is preferably 0.010% or less.

(b) Alloyed Steel Powder

As the above alloyed steel powder, an alloyed steel powder containing Mo in an amount of 0.3% to 4.5%, Si in an amount of 0% to 0.2%, and Mn in an amount of 0% to 0.4%, with the balance being Fe and inevitable impurities, is used. The alloyed steel powder has a role of supplying Mo, which is an alloying element. By using a mixture of (b) the alloyed steel powder containing Mo and (a) the iron-based powder containing no Mo, both excellent powder compressibility and high mechanical strength of the sintered body can be achieved at a high level.

Mo: 0.3% to 4.5%

As mentioned above, since Mo is difficult to oxidize and to be reduced to the same degree as Fe, an alloyed steel powder containing Mo can be produced relatively easily. In addition to the function of transformation strengthening of the matrix phase during quenching by the quench hardenability improving effect, Mo acts to achieve solid solution strengthening of the matrix phase when distributed to the matrix phase and strengthening by precipitation of the matrix phase by forming fine carbides in the matrix phase. Mo also has the effect of enhancing carburization because it has a good gas carburizing property and is a non-intergranular-oxidation element. Therefore, Mo is very useful as a strengthening element.

However, in the present disclosure, since the iron-based powder and the alloyed steel powder are mixed and used, the Mo content of the whole mixed powder for powder metallurgy is lower than that of the original alloyed steel powder. For example, when the mixed powder for powder metallurgy consists only of iron-based powder and alloying powder, the percentage of the alloyed steel powder is 50% to 90% as described later, the Mo content of the whole mixed powder is 1/2 to 9/10 of that in the alloyed steel powder. In consideration of this, the Mo content of the alloyed steel powder is 0.3% or more. If the Mo content is less than 0.3%, the above-described effect of Mo as a strengthening element can not be sufficiently obtained. On the other hand, when the Mo content of the alloyed steel powder exceeds 4.5%, the toughness is lowered. Therefore, the Mo content of the alloyed steel powder is 4.5% or less.

Since alloying elements other than Mo are basically not used, the balance other than Mo of the alloyed steel powder may be Fe and inevitable impurities. Note that general alloyed steel powder contains Si and Mn as impurities. As described above, Si and Mn are elements having the effect of improving the hardenability in addition to the effect of improving the strength by solid solution strengthening. Therefore, when Si and Mn are contained, the strength of the sintered body may be improved depending on the cooling conditions at the time of sintering the press-formed product and the conditions such as quenching and tempering conditions, and hence these elements may work advantageously in reverse. For the above reasons, the alloyed steel powder is permitted to contain one or both of Si and Mn in the range described below.

Si: 0% to 0.2%

Si is an element having the effect of increasing the strength of steel by quench hardenability improvement, solid solution strengthening, and the like. However, when the Si content in the alloyed steel powder exceeds 0.2%, the formation of oxides increases and the compressibility decreases, and the oxides become the starting point of fracture in the sintered body, causing the fatigue strength and toughness to decrease. Therefore, the Si content of the alloyed steel powder is 0.2% or less. On the other hand, as mentioned above, from the viewpoint of compressibility, a lower Si content is preferable. Thus, the Si content may be 0%. Therefore, the Si content of the alloyed steel powder is 0% or more.

Mn: 0% to 0.4%

Mn, like Si, is also an element having the effect of increasing the strength of steel by hardenability improvement, solid solution strengthening, and the like. However, when the Mn content in the alloyed steel powder exceeds 0.4%, more oxides form and the compressibility decreases, and the oxides become the starting point of fracture in the sintered body, causing the fatigue strength and toughness to decrease. Therefore, the Mn content of the alloyed steel powder is 0.4% or less. On the other hand, as described above, from the viewpoint of compressibility, a lower Mn content is preferable. Thus, the Mn content may be 0%. Therefore, the Mn content of the alloyed steel powder is 0% or more.

Although the amount of inevitable impurities (Si and Mn excluded) contained in the above alloyed steel powder is not particularly limited, the total amount is preferably 1.0 mass % or less, more preferably 0.5 mass % or less, and even more preferably 0.3 mass % or less. Among the elements contained as inevitable impurities, the P content is preferably 0.020% or less. The S content is preferably 0.010% or less. The 0 content is preferably 0.20% or less. The N content is preferably 0.0015% or less. The Al content is preferably 0.001% or less.

The alloyed steel powder is not particularly limited, and any powder may be used as long as it has the above-described chemical composition. For example, the alloyed steel powder may be one or both of a pre-alloyed steel powder and a partially diffusion-alloyed steel powder. In addition, as the partially diffusion-alloyed steel powder, one or both of an iron powder (pure iron powder) with an alloying element diffusion-bonded to the surface thereof, and a pre-alloyed steel powder with an alloying element diffused and attached on the surface thereof.

Ratio of the Alloyed Steel Powder: 50% to 90%

The ratio of the mass of (b) the alloyed steel powder to the total mass of (a) the iron-based powder and (b) the alloyed steel powder (hereinafter simply referred to as "the ratio of the alloyed steel powder") is from 50% to 90%. When the ratio of the alloyed steel powder is less than 50%, that is, the ratio of the iron-based powder exceeds 50%, the portions of the iron-based powder having low strength are connected inside the sintered body, and when the sintered body is stressed, a crack develops in portions having lower strength, which tends to lead to a fracture. Therefore, the ratio of the alloyed steel powder is 50% or more. On the other hand, when the ratio of the alloyed steel powder exceeds 90%, that is, the ratio of the iron-based powder is less than 10%, the soft portions contributing to the compressibility decrease, and the compressibility of the whole mixed powder is insufficient. Therefore, the ratio of the alloyed steel powder is 90% or less. Furthermore, since the tensile strength of the sintered body tends to be maximum when the ratio of the alloyed steel powder is about 80%, the ratio of the alloyed steel powder is preferably from 70% to 90%.

Ratio of Mo: 0.20% or More and Less than 2.20%

When the ratio of the mass of Mo to the total mass of (a) the iron-based powder and (b) the alloyed steel powder (hereinafter simply referred to as "the ratio of Mo") is less than 0.20%, the effect of Mo as an strengthening element is insufficient. Therefore, the ratio of Mo is 0.20% or more. On the other hand, the excessive addition of Mo causes an increase in alloy cost, the ratio of Mo is less than 2.20%.

The mixed powder for powder metallurgy in one of the embodiments disclosed herein may be made of (a) the iron-based powder and (b) the alloyed steel powder only (iron-based powder+alloyed steel powder=100%), it may also contain any other component(s). In this case, the ratio of the total mass of (a) the iron-based powder and (b) the alloyed steel powder to the total mass of the mixed powder for powder metallurgy is not particularly limited, and may be an arbitrary value. However, by increasing the ratio, the mechanical properties of the sintered body can be further improved. Therefore, the ratio of the total mass of (a) the iron-based powder and (b) the alloyed steel powder to the total mass of the mixed powder for powder metallurgy is preferably 90% or more, and more preferably 95%. On the other hand, the upper limit of the ratio is not particularly limited, and may be 100%.

In one of the disclosed embodiments, (c) Cu powder and (d) graphite powder may be further added to the mixed powder for powder metallurgy. By adding Cu powder and graphite powder, the strength of the sintered body can be further improved.

(c) Cu Powder

Cu is an element that promotes the solid solution strengthening and the quench hardenability improvement of the iron-based powder and has the effect of increasing the strength of the sintered body. If the addition amount of the Cu powder is less than 0.5%, the above-described effect can not be sufficiently obtained. Therefore, when the Cu powder is used, the addition amount of the Cu powder is 0.5% or more. The addition amount of the Cu powder is preferably 1.0% or more. On the other hand, when the addition amount of the Cu powder exceeds 4.0%, not only the strength improving effect of the sintered parts is saturated, but rather the sintering density is lowered. Therefore, the addition amount of the Cu powder is 4.0% or less. The addition amount of the Cu powder is preferably 3.0% or less. As used herein, "the addition amount of the Cu powder" means the ratio of the mass of (c) the Cu powder to the total mass of (a) the iron-based powder, (b) the alloyed steel powder, (c) the Cu powder, and (d) the graphite powder.

(d) Graphite Powder

Graphite is an effective component to increase the strength. If the addition amount of the graphite powder is less than 0.2%, the above effect can not be sufficiently obtained. Therefore, when the graphite powder is used, the addition amount of the graphite powder is 0.2% or more. The addition amount of the graphite powder is preferably 0.3% or more. On the other hand, when the addition amount of the graphite powder exceeds 1.0%, the precipitation amount of cementite due to hypereutectoid increases to cause a decrease in strength. Therefore, the addition amount of the graphite powder is 1.0% or less. The addition amount of the graphite powder is preferably 0.8% or less. As used herein, "the addition amount of the graphite powder" refers to the ratio of the mass of (d) the graphite powder to the total mass of (a) the iron-based powder, (b) the alloyed steel powder, (c) the Cu powder, and (d) the graphite powder.

In one of the disclosed embodiments, (e) a lubricant can be further added to the mixed powder for powder metallurgy. By adding the lubricant, it is possible to suppress the wear at the time of pressing of the mixed powder for powder metallurgy to extend the life of the mold and to further increase the density of the formed body.

(e) Lubricant

If the addition amount of the lubricant is less than 0.2%, the above effect is hardly exhibited. Therefore, when the lubricant is used, the addition amount of the lubricant is 0.2% or more. The addition amount of the lubricant is preferably 0.3% or more. On the other hand, when the addition amount of the lubricant exceeds 1.5%, the non-metal part in the mixed powder increases and the forming density becomes difficult to increase, causing the strength to decrease. Therefore, the addition amount of the lubricant is 1.5% or less. The addition amount of the lubricant is preferably 1.2% or less. As used herein, "the addition amount of the lubricant" means the ratio of the mass of (e) the lubricant to the total mass of (a) the iron-based powder, (b) the alloyed steel powder, (c) the Cu powder, and (d) the graphite powder.

The lubricant is not particularly limited and may be of any type. As the lubricant, for example, one or more selected from the group consisting of fatty acids, fatty acid amides, fatty acid bisamides, and metal soaps can be used. Among them, metal soaps such as lithium stearate and zinc stearate, or amide-based lubricants such as ethylene bis stearoamide are preferably used.

In addition to the method for adding and mixing a lubricant to the mixed powder, a method for directly applying a lubricant to a mold can also be used, and a method for combining both can also be used.

In one of the disclosed embodiments, a sintered body can be produced using the above-described mixed powder for powder metallurgy. The method for producing the sintered body is not particularly limited, and may be produced by any method. However, usually, the mixed powder for powder metallurgy may be pressed and formed into a formed body according to a conventional method in powder metallurgy, and then sintered.

The density of the formed body (sometimes referred to as the "forming density") is not particularly limited, yet from the viewpoint of securing sufficient mechanical properties (such as toughness), it is preferably 7.00 $Mg/m^3$ or more. Moreover, although the tensile strength required for the sintered body varies with the uses and the like, it is preferable that the sintered body have a tensile strength of 500 MPa or more.

EXAMPLES

Example 1

Mixed powders for powder metallurgy were produced using an iron-based powder containing Si and Mn only as inevitable impurities and an alloyed steel powder, and the performance was evaluated. The specific steps were as follows.

(a) The iron-based powder was produced by subjecting the iron powder produced by the water atomization method to a finish reduction treatment at 900° C. for 60 minutes in hydrogen atmosphere for decarburization and deoxidation, and subjecting the obtained cake to a crushing treatment. The chemical compositions of the obtained iron-based powders are listed in Table 1. Note that the elements illustrated in Table 1 are all contained as inevitable impurities in the iron-based powder.

(b) As the alloyed steel powder, two different powders, i.e., a pre-alloyed steel powder and a composite alloyed steel powder were used. The pre-alloyed steel powder was produced by the same method as the above-described iron-based powder except that one containing Mo was used as the molten metal to be subjected to water atomization. As a result, the alloyed steel powder was obtained in which all of Mo as an alloying element was added as a pre-alloy. The chemical compositions of the obtained alloyed steel powders are listed in Table 1.

The composite alloyed steel powder was produced by producing a pre-alloyed steel powder containing 1.5 mass % of Mo with the same method as the above pre-alloyed steel powder, and further diffusion-bonding Mo on the surface of the obtained pre-alloyed steel powder. In the diffusion-bonding process, the pre-alloyed steel powder was mixed with $MoO_3$ powder in an amount equivalent to the Mo content of 0.4 mass %, 0.7 mass %, 1.0 mass %, 1.4 mass %, 2.3 mass %, and 5.4 mass %, respectively, and the mixture was subjected to a heat treatment in hydrogen atmosphere at 900° C. for 60 minutes. By the heat treatment, the pre-alloyed steel powder was decarburized and deoxidized, and at the same time, Mo generated by reduction of $MoO_3$ was diffusion-bonded to the pre-alloyed steel powder. By crushing the cake obtained by the above-described treatment, a composite alloyed steel powder in which Mo was diffusion-bonded to the surface of the pre-alloyed steel powder was obtained. The chemical compositions of the obtained composite alloyed steel powders are also listed in Table 1.

Next, (a) the iron-based powder and (b) the alloyed steel powder thus obtained were mixed in a V-type mixer for 15 minutes in the combination and ratio listed in Table 2 to obtain a mixed powder of iron-based powder and alloyed steel powder. The mixing ratio of (a) the iron-based powder and (b) the alloyed steel powder was selected intending that the ratio of Mo to the total of (a) the iron-based powder and (b) the alloyed steel powder be 0.3 mass % and 2.0 mass %, and the calculated values of the ratio of Mo are also listed in Table 2.

Then, Cu powder, graphite powder, and Wax-based lubricant powder were further added to each mixed powder of iron base powder and alloyed steel powder in the proportions listed in Table 2 and mixed in a V-type mixer for 15 minutes to obtain a mixed powder for powder metallurgy. In Nos. 1 to 3, only the lubricant was added without using the Cu powder and the graphite powder.

The properties of the obtained mixed powder for powder metallurgy were evaluated in the following procedure.

Density of Press-Formed Body

Using the mixed powders for powder metallurgy, press-formed bodies were produced as test pieces, and their densities were evaluated, respectively. Each press-formed body was in the form of a ring having an outer diameter of 38 mmϕ, an inner diameter of 25 mmϕ, and a height of 10 mm, and the forming pressure was 686 MPa. The weight of the obtained formed body was measured, and the density was determined by dividing the measured weight by the volume calculated from the dimensions. The results are as listed in Table 2.

Tensile Strength of Sintered Body

As a tension test piece, a sintered body was fabricated from each mixed powder for powder metallurgy, and the tensile strength was measured. The tensile test piece was produced by forming a mixed powder for powder metallurgy into a tensile test piece having a parallel part of 5.8 mm wide and 5 mm high, and performing sintering for 20 minutes at 1130° C. in RX gas atmosphere. The results are listed in Table 2.

From the results in Table 2, it can be seen that as the mixing ratio of the iron-based powder increases, the forming density increases, and the tensile strength tends to increase and then decrease. In each example satisfying the conditions according to the present disclosure, the forming density of 7.00 Mg/m$^3$ or more and the tensile strength of 500 MPa or more were obtained. In contrast, in each case where the mixing ratio of the iron-based powder was 0 mass %, when the Mo content of the mixed powder was 0.30 mass %, the tensile strength did not reach 500 MPa, and when the Mo content of the mixed powder was 1.91 mass %, the forming density did not reach 7.00 Mg/m$^3$. In addition, in each case where the mixing ratio of the pure iron powder was 70 mass % or more, the tensile strength did not reach 500 MPa when the Mo content of the mixed powder was 0.31 mass % or 2.06 mass %.

Example 2

Mixed powders for powder metallurgy were produced in the same manner as in Example 1 except that an iron-based powder containing Mn and an alloyed steel powder were used, and the performance was evaluated. Table 3 lists the compositions of the iron-based powder and alloyed steel powder used, and Table 4 lists the blending ratio of each component and the evaluation results.

As can be seen from the results in Table 4, as in the case of Example 1, as the mixing ratio of the iron-based powder increases, the forming density increases, and the tensile strength once increases and then decreases. In addition, in each example satisfying the conditions according to the present disclosure, the forming density of 7.00 Mg/m$^3$ or more and the tensile strength of 500 MPa or more were obtained.

TABLE 1

| | | | Chemical composition (mass %)* | | | | | | | | |
|---|---|---|---|---|---|---|---|---|---|---|---|
| Type | ID | Type of alloyed steel powder | C | Si | Mn | P | S | O | N | Al | Mo |
| (a) Iron-based powder | a-1 | — | 0.003 | 0.012 | 0.02 | 0.009 | 0.005 | 0.18 | 0.0009 | <0.001 | 0.004 |
| | a-2 | — | 0.003 | 0.013 | 0.03 | 0.011 | 0.006 | 0.16 | 0.0010 | <0.001 | 0.005 |
| (b) Alloyed steel powder | b-01 | pre-alloyed steel powder | 0.002 | 0.012 | 0.03 | 0.012 | 0.005 | 0.16 | 0.0006 | <0.001 | 0.30 |
| | b-02 | pre-alloyed steel powder | 0.002 | 0.013 | 0.04 | 0.013 | 0.003 | 0.16 | 0.0007 | <0.001 | 0.33 |
| | b-03 | pre-alloyed steel powder | 0.003 | 0.012 | 0.02 | 0.013 | 0.004 | 0.17 | 0.0006 | <0.001 | 0.39 |
| | b-04 | pre-alloyed steel powder | 0.002 | 0.012 | 0.03 | 0.012 | 0.005 | 0.16 | 0.0005 | <0.001 | 0.43 |
| | b-05 | pre-alloyed steel powder | 0.003 | 0.013 | 0.02 | 0.011 | 0.004 | 0.16 | 0.0005 | <0.001 | 0.60 |
| | b-06 | pre-alloyed steel powder | 0.003 | 0.014 | 0.04 | 0.013 | 0.004 | 0.17 | 0.0006 | <0.001 | 1.02 |
| | b-11 | composite alloyed steel powder | 0.003 | 0.015 | 0.03 | 0.014 | 0.006 | 0.16 | 0.0006 | <0.001 | 1.91 |
| | b-12 | composite alloyed steel powder | 0.002 | 0.014 | 0.04 | 0.013 | 0.007 | 0.16 | 0.0007 | <0.001 | 2.21 |
| | b-13 | composite alloyed steel powder | 0.003 | 0.013 | 0.03 | 0.013 | 0.006 | 0.16 | 0.0006 | <0.001 | 2.54 |
| | b-14 | composite alloyed steel powder | 0.002 | 0.014 | 0.03 | 0.014 | 0.006 | 0.17 | 0.0007 | <0.001 | 2.88 |
| | b-15 | composite alloyed steel powder | 0.003 | 0.013 | 0.03 | 0.014 | 0.006 | 0.17 | 0.0006 | <0.001 | 3.81 |
| | b-16 | composite alloyed steel powder | 0.002 | 0.014 | 0.04 | 0.014 | 0.007 | 0.16 | 0.0005 | <0.001 | 6.86 |

*The balance is Fe and other inevitable impurities.

TABLE 2

| | Formulation of mixed powder for powder metallurgy | | | | | | | | Evaluation result | | |
|---|---|---|---|---|---|---|---|---|---|---|---|
| | (a) Iron-based powder | | (b) Alloyed steel powder | | | (c) Cu powder | (d) Graphite powder | (e) Lubricant | | | |
| No. | Type | Addition amount *1 (mass %) | Type | Addition amount *1 (mass %) | Ratio of Mo *1 (mass %) | Additon amount *2 (mass %) | Additon amount *2 (mass %) | Additon amount *2 (mass %) | Density of formed body (Mg/m$^3$) | Tensile strength of sintered body (MPa) | Category |
| 1 | a-1 | 0 | b-01 | 100 | 0.30 | 0.0 | 0.0 | 0.5 | 7.18 | 438 | Comparative Example |
| 2 | | 20 | b-03 | 80 | 0.31 | 0.0 | 0.0 | 0.5 | 7.21 | 510 | Example |
| 3 | | 30 | b-04 | 70 | 0.30 | 0.0 | 0.0 | 0.5 | 7.22 | 505 | Example |
| 4 | | 70 | b-06 | 30 | 0.31 | 0.0 | 0.0 | 0.5 | 7.24 | 436 | Comparative Example |
| 5 | a-1 | 0 | b-01 | 100 | 0.30 | 2.0 | 0.7 | 0.5 | 7.13 | 452 | Comparative Example |
| 6 | | 10 | b-02 | 90 | 0.30 | 2.0 | 0.7 | 0.5 | 7.17 | 501 | Example |
| 7 | | 20 | b-03 | 80 | 0.31 | 2.0 | 0.7 | 0.5 | 7.18 | 532 | Example |
| 8 | | 30 | b-04 | 70 | 0.30 | 2.0 | 0.7 | 0.5 | 7.18 | 527 | Example |
| 9 | | 50 | b-05 | 50 | 0.30 | 2.0 | 0.7 | 0.5 | 7.19 | 513 | Example |
| 10 | | 70 | b-06 | 30 | 0.31 | 2.0 | 0.7 | 0.5 | 7.20 | 453 | Comparative Example |
| 11 | a-2 | 0 | b-11 | 100 | 1.91 | 2.0 | 0.7 | 0.5 | 6.93 | 587 | Comparative Example |
| 12 | | 10 | b-12 | 90 | 1.99 | 2.0 | 0.7 | 0.5 | 7.02 | 608 | Example |
| 13 | | 20 | b-13 | 80 | 2.03 | 2.0 | 0.7 | 0.5 | 7.07 | 630 | Example |
| 14 | | 30 | b-14 | 70 | 2.02 | 2.0 | 0.7 | 0.5 | 7.10 | 622 | Example |
| 15 | | 50 | b-15 | 50 | 1.91 | 2.0 | 0.7 | 0.5 | 7.14 | 596 | Example |
| 16 | | 70 | b-16 | 30 | 2.06 | 2.0 | 0.7 | 0.5 | 7.18 | 491 | Comparative Example |

*1: Ratio to the total of (a) iron-based powder and (b) alloyed steel powder.

*2: Ratio to the total of (a) iron-based powder, (b) alloyed steel powder, (c) Cu powder, and (d) graphite powder.

TABLE 3

| Type | ID | Type of alloyed steel powder | Chemical composition (mass %)* | | | | | | | | |
|---|---|---|---|---|---|---|---|---|---|---|---|
| | | | C | Si | Mn | P | S | O | N | Al | Mo |
| (a) Iron-based powder | a-3 | — | 0.002 | 0.012 | 0.22 | 0.011 | 0.004 | 0.16 | 0.0005 | <0.001 | 0.003 |
| | a-4 | — | 0.003 | 0.015 | 0.15 | 0.010 | 0.004 | 0.16 | 0.0009 | <0.001 | 0.004 |
| (b) Alloyed steel powder | b-21 | pre-alloyed steel powder | 0.003 | 0.012 | 0.21 | 0.012 | 0.004 | 0.18 | 0.0006 | <0.001 | 0.30 |
| | b-22 | pre-alloyed steel powder | 0.003 | 0.013 | 0.21 | 0.011 | 0.006 | 0.16 | 0.0007 | <0.001 | 0.34 |
| | b-23 | pre-alloyed steel powder | 0.004 | 0.013 | 0.22 | 0.013 | 0.006 | 0.17 | 0.0007 | <0.001 | 0.39 |
| | b-24 | pre-alloyed steel powder | 0.003 | 0.014 | 0.22 | 0.012 | 0.005 | 0.17 | 0.0007 | <0.001 | 0.45 |
| | b-25 | pre-alloyed steel powder | 0.002 | 0.012 | 0.22 | 0.012 | 0.005 | 0.16 | 0.0006 | <0.001 | 0.57 |
| | b-26 | pre-alloyed steel powder | 0.003 | 0.014 | 0.21 | 0.013 | 0.004 | 0.17 | 0.0007 | <0.001 | 0.97 |
| | b-31 | composite alloyed steel powder | 0.004 | 0.010 | 0.20 | 0.014 | 0.006 | 0.16 | 0.0005 | <0.001 | 0.30 |
| | b-32 | composite alloyed steel powder | 0.003 | 0.011 | 0.19 | 0.014 | 0.005 | 0.16 | 0.0004 | <0.001 | 0.33 |
| | b-33 | composite alloyed steel powder | 0.003 | 0.013 | 0.20 | 0.015 | 0.005 | 0.17 | 0.0006 | <0.001 | 0.38 |
| | b-34 | composite alloyed steel powder | 0.003 | 0.011 | 0.20 | 0.013 | 0.005 | 0.16 | 0.0004 | <0.001 | 0.42 |
| | b-35 | composite alloyed steel powder | 0.005 | 0.010 | 0.21 | 0.015 | 0.006 | 0.16 | 0.0004 | <0.001 | 0.62 |
| | b-36 | composite alloyed steel powder | 0.004 | 0.010 | 0.21 | 0.013 | 0.005 | 0.17 | 0.0004 | <0.001 | 1.04 |
| | b-41 | pre-alloyed steel powder | 0.005 | 0.014 | 0.20 | 0.015 | 0.005 | 0.16 | 0.0005 | <0.001 | 0.49 |
| | b-42 | pre-alloyed steel powder | 0.003 | 0.014 | 0.20 | 0.016 | 0.004 | 0.16 | 0.0006 | <0.001 | 0.58 |
| | b-44 | pre-alloyed steel powder | 0.004 | 0.013 | 0.19 | 0.015 | 0.005 | 0.17 | 0.0006 | <0.001 | 0.71 |
| | b-45 | pre-alloyed steel powder | 0.004 | 0.015 | 0.19 | 0.014 | 0.004 | 0.18 | 0.0007 | <0.001 | 1.02 |
| | b-46 | pre-alloyed steel powder | 0.005 | 0.013 | 0.20 | 0.016 | 0.004 | 0.17 | 0.0007 | <0.001 | 1.63 |
| | b-51 | pre-alloyed steel powder | 0.003 | 0.010 | 0.19 | 0.014 | 0.003 | 0.16 | 0.0008 | <0.001 | 1.05 |
| | b-52 | pre-alloyed steel powder | 0.002 | 0.011 | 0.21 | 0.013 | 0.004 | 0.17 | 0.0007 | <0.001 | 1.15 |
| | b-53 | pre-alloyed steel powder | 0.003 | 0.012 | 0.21 | 0.014 | 0.005 | 0.16 | 0.0006 | <0.001 | 1.38 |
| | b-54 | pre-alloyed steel powder | 0.002 | 0.011 | 0.22 | 0.014 | 0.003 | 0.16 | 0.0006 | <0.001 | 1.58 |
| | b-55 | pre-alloyed steel powder | 0.004 | 0.010 | 0.20 | 0.014 | 0.002 | 0.16 | 0.0008 | <0.001 | 2.23 |
| | b-56 | pre-alloyed steel powder | 0.003 | 0.013 | 0.20 | 0.013 | 0.004 | 0.16 | 0.0005 | <0.001 | 3.52 |
| | b-61 | composite alloyed steel powder | 0.003 | 0.016 | 0.20 | 0.014 | 0.008 | 0.16 | 0.0006 | <0.001 | 2.11 |
| | b-62 | composite alloyed steel powder | 0.003 | 0.015 | 0.20 | 0.015 | 0.006 | 0.16 | 0.0007 | <0.001 | 2.29 |
| | b-63 | composite alloyed steel powder | 0.003 | 0.014 | 0.21 | 0.014 | 0.007 | 0.17 | 0.0007 | <0.001 | 2.64 |
| | b-64 | composite alloyed steel powder | 0.004 | 0.016 | 0.20 | 0.015 | 0.005 | 0.16 | 0.0005 | <0.001 | 3.06 |
| | b-65 | composite alloyed steel powder | 0.003 | 0.016 | 0.21 | 0.014 | 0.005 | 0.16 | 0.0006 | <0.001 | 4.31 |
| | b-66 | composite alloyed steel powder | 0.003 | 0.015 | 0.20 | 0.013 | 0.007 | 0.16 | 0.0005 | <0.001 | 7.03 |

*The balance is Fe and other inevitable impurities.

TABLE 4

| | Formulation of mixed powder for powder metallurgy | | | | | | | | Evaluation result | | |
|---|---|---|---|---|---|---|---|---|---|---|---|
| | (a) Iron-based powder | | (b) Alloyed steel powder | | | (c) Cu powder | (d) Graphite powder | (e) Lubricant | Density of | Tensile strength of | |
| No. | Type | Additon amount *1 (mass %) | Type | Additon amount *1 (mass %) | Ratio of Mo *1 (mass %) | Additon amount *2 (mass %) | Additon amount *2 (mass %) | Additon amount *2 (mass %) | formed body ($Mg/m^3$) | sintered body (MPa) | Category |
| 16 | a-3 | 0 | b-21 | 100 | 0.30 | 2.0 | 0.7 | 0.5 | 7.12 | 463 | Comparative Example |
| 17 | | 10 | b-22 | 90 | 0.31 | 2.0 | 0.7 | 0.5 | 7.15 | 508 | Example |
| 18 | | 20 | b-23 | 80 | 0.31 | 2.0 | 0.7 | 0.5 | 7.17 | 548 | Example |
| 19 | | 30 | b-24 | 70 | 0.32 | 2.0 | 0.7 | 0.5 | 7.18 | 541 | Example |
| 20 | | 50 | b-25 | 50 | 0.29 | 2.0 | 0.7 | 0.5 | 7.18 | 534 | Example |
| 21 | | 70 | b-26 | 30 | 0.29 | 2.0 | 0.7 | 0.5 | 7.18 | 458 | Comparative Example |
| 22 | a-4 | 0 | b-31 | 100 | 0.30 | 2.0 | 0.7 | 0.5 | 7.13 | 477 | Comparative Example |
| 23 | | 10 | b-32 | 90 | 0.30 | 2.0 | 0.7 | 0.5 | 7.15 | 532 | Example |
| 24 | | 20 | b-33 | 80 | 0.30 | 2.0 | 0.7 | 0.5 | 7.16 | 556 | Example |
| 25 | | 30 | b-34 | 70 | 0.30 | 2.0 | 0.7 | 0.5 | 7.17 | 554 | Example |
| 26 | | 50 | b-35 | 50 | 0.31 | 2.0 | 0.7 | 0.5 | 7.18 | 549 | Example |
| 27 | | 70 | b-36 | 30 | 0.31 | 2.0 | 0.7 | 0.5 | 7.19 | 463 | Comparative Example |
| 28 | a-3 | 0 | b-41 | 100 | 0.49 | 2.0 | 0.7 | 0.5 | 7.10 | 494 | Comparative Example |
| 29 | | 10 | b-42 | 90 | 0.52 | 2.0 | 0.7 | 0.5 | 7.12 | 546 | Example |
| 30 | | 20 | b-43 | 80 | 0.51 | 2.0 | 0.7 | 0.5 | 7.13 | 572 | Example |
| 31 | | 30 | b-44 | 70 | 0.50 | 2.0 | 0.7 | 0.5 | 7.14 | 567 | Example |
| 32 | | 50 | b-45 | 50 | 0.51 | 2.0 | 0.7 | 0.5 | 7.15 | 551 | Example |
| 33 | | 70 | b-46 | 30 | 0.49 | 2.0 | 0.7 | 0.5 | 7.16 | 472 | Comparative Example |
| 34 | a-4 | 0 | b-51 | 100 | 1.05 | 2.0 | 0.7 | 0.5 | 6.98 | 529 | Comparative Example |
| 35 | | 10 | b-52 | 90 | 1.04 | 2.0 | 0.7 | 0.5 | 7.06 | 563 | Example |
| 36 | | 20 | b-53 | 80 | 1.10 | 2.0 | 0.7 | 0.5 | 7.11 | 583 | Example |
| 37 | | 30 | b-54 | 70 | 1.11 | 2.0 | 0.7 | 0.5 | 7.13 | 578 | Example |
| 38 | | 50 | b-55 | 50 | 1.12 | 2.0 | 0.7 | 0.5 | 7.16 | 557 | Example |
| 39 | | 70 | b-56 | 30 | 1.06 | 2.0 | 0.7 | 0.5 | 7.18 | 485 | Comparative Example |
| 40 | a-4 | 0 | b-61 | 100 | 2.11 | 2.0 | 0.7 | 0.5 | 6.92 | 593 | Comparative Example |
| 41 | | 10 | b-62 | 90 | 2.06 | 2.0 | 0.7 | 0.5 | 7.00 | 617 | Example |
| 42 | | 20 | b-63 | 80 | 2.11 | 2.0 | 0.7 | 0.5 | 7.06 | 634 | Example |
| 43 | | 30 | b-64 | 70 | 2.14 | 2.0 | 0.7 | 0.5 | 7.09 | 628 | Example |

TABLE 4-continued

| | Formulation of mixed powder for powder metallurgy | | | | | | | | Evaluation result | | |
|---|---|---|---|---|---|---|---|---|---|---|---|
| | (a) Iron-based powder | | (b) Alloyed steel powder | | | (c) Cu powder | (d) Graphite powder | (e) Lubricant | Density of | Tensile strength of | |
| No. | Type | Additon amount *1 (mass %) | Type | Additon amount *1 (mass %) | Ratio of Mo *1 (mass %) | Additon amount *2 (mass %) | Additon amount *2 (mass %) | Additon amount *2 (mass %) | formed body ($Mg/m^3$) | sintered body (MPa) | Category |
| 44 | | 50 | b-65 | 50 | 2.16 | 2.0 | 0.7 | 0.5 | 7.14 | 600 | Example |
| 45 | | 70 | b-66 | 30 | 2.11 | 2.0 | 0.7 | 0.5 | 7.17 | 496 | Comparative Example |

*1: Ratio to the total of (a) iron-based powder and (b) alloyed steel powder.

*2: Ratio to the total of (a) iron-based powder, (b) alloyed steel powder, (c) Cu powder, and (d) graphite powder.

Example 3

Mixed powders for powder metallurgy were produced in the same manner as in Example 1 except that an iron-based powder containing Si and Mn and an alloyed steel powder were used, and the performance was evaluated. Table 5 lists the compositions of the iron-based powder and alloyed steel powder used, and Table 6 lists the blending ratio of each component and the evaluation results.

As can be seen from the results in Table 6, as in the case of Examples 1 and 2, as the mixing ratio of the iron-based powder increases, the forming density increases, and the tensile strength once increases and then decreases. In addition, in each example satisfying the conditions according to the present disclosure, the forming density of 7.00 $Mg/m^3$ or more and the tensile strength of 500 MPa or more were obtained. Further, in Examples 2 and 3 using the raw material powder containing one or both of Si and Mn, it can be seen that the tensile strength of the sintered body was improved compared to Example 1 while maintaining the high density of the sintered body. From this follows that it is preferable to add one or both of Si and Mn when importance is attached to strength.

TABLE 5

| | | | Chemical composition (mass %)* | | | | | | | | |
|---|---|---|---|---|---|---|---|---|---|---|---|
| Type | ID | Type of alloyed steel powder | C | Si | Mn | P | S | O | N | Al | Mo |
| (a) Iron-based powder | a-5 | — | 0.003 | 0.19 | 0.38 | 0.012 | 0.005 | 0.16 | 0.0004 | <0.001 | 0.004 |
| | a-6 | — | 0.002 | 0.18 | 0.40 | 0.012 | 0.004 | 0.16 | 0.0005 | <0.001 | 0.004 |
| (b) Alloyed steel powder | b-71 | pre-alloyed steel powder | 0.004 | 0.20 | 0.38 | 0.013 | 0.005 | 0.16 | 0.0006 | <0.001 | 0.30 |
| | b-72 | pre-alloyed steel powder | 0.004 | 0.19 | 0.40 | 0.013 | 0.005 | 0.16 | 0.0006 | <0.001 | 0.32 |
| | b-73 | pre-alloyed steel powder | 0.004 | 0.19 | 0.39 | 0.015 | 0.006 | 0.17 | 0.0006 | <0.001 | 0.37 |
| | b-74 | pre-alloyed steel powder | 0.003 | 0.20 | 0.40 | 0.014 | 0.005 | 0.16 | 0.0005 | <0.001 | 0.46 |
| | b-75 | pre-alloyed steel powder | 0.003 | 0.20 | 0.38 | 0.013 | 0.005 | 0.16 | 0.0006 | <0.001 | 0.57 |
| | b-76 | pre-alloyed steel powder | 0.003 | 0.18 | 0.39 | 0.014 | 0.004 | 0.16 | 0.0006 | <0.001 | 1.02 |
| | b-81 | composite alloyed steel powder | 0.005 | 0.20 | 0.38 | 0.016 | 0.006 | 0.17 | 0.0005 | <0.001 | 1.91 |
| | b-82 | composite alloyed steel powder | 0.005 | 0.18 | 0.39 | 0.015 | 0.006 | 0.17 | 0.0004 | <0.001 | 2.21 |
| | b-83 | composite alloyed steel powder | 0.003 | 0.18 | 0.38 | 0.015 | 0.006 | 0.18 | 0.0005 | <0.001 | 2.65 |
| | b-84 | composite alloyed steel powder | 0.005 | 0.18 | 0.39 | 0.016 | 0.007 | 0.18 | 0.0004 | <0.001 | 2.88 |
| | b-85 | composite alloyed steel powder | 0.004 | 0.20 | 0.38 | 0.016 | 0.007 | 0.18 | 0.0005 | <0.001 | 3.81 |
| | b-86 | composite alloyed steel powder | 0.004 | 0.18 | 0.40 | 0.015 | 0.006 | 0.18 | 0.0004 | <0.001 | 6.86 |

*The balance is Fe and other inevitable impurities.

TABLE 6

| | Formulation of mixed powder for powder metallurgy | | | | | | | | Evaluation result | | |
|---|---|---|---|---|---|---|---|---|---|---|---|
| | (a) Iron-based powder | | (b) Alloyed steel powder | | | (c) Cu powder | (d) Graphite powder | (e) Lubricant | Density of | Tensile strength of | |
| No. | Type | Additon amount *1 (mass %) | Type | Additon amount *1 (mass %) | Ratio of Mo *1 (mass %) | Additon amount *2 (mass %) | Additon amount *2 (mass %) | Additon amount *2 (mass %) | formed body ($Mg/m^3$) | sintered body (MPa) | Category |
| 46 | a-5 | 0 | b-71 | 100 | 0.30 | 2.0 | 0.7 | 0.5 | 7.10 | 465 | Comparative Example |
| 47 | | 10 | b-72 | 90 | 0.29 | 2.0 | 0.7 | 0.5 | 7.14 | 524 | Example |
| 48 | | 20 | b-73 | 80 | 0.30 | 2.0 | 0.7 | 0.5 | 7.15 | 557 | Example |
| 49 | | 30 | b-74 | 70 | 0.32 | 2.0 | 0.7 | 0.5 | 7.16 | 555 | Example |
| 50 | | 50 | b-75 | 50 | 0.29 | 2.0 | 0.7 | 0.5 | 7.17 | 548 | Example |
| 51 | | 70 | b-76 | 30 | 0.31 | 2.0 | 0.7 | 0.5 | 7.17 | 472 | Comparative Example |
| 52 | a-6 | 0 | b-81 | 100 | 1.91 | 2.0 | 0.7 | 0.5 | 6.91 | 602 | Comparative Example |
| 53 | | 10 | b-82 | 90 | 1.99 | 2.0 | 0.7 | 0.5 | 7.01 | 622 | Example |
| 54 | | 20 | b-83 | 80 | 2.12 | 2.0 | 0.7 | 0.5 | 7.05 | 640 | Example |
| 55 | | 30 | b-84 | 70 | 2.02 | 2.0 | 0.7 | 0.5 | 7.08 | 634 | Example |

TABLE 6-continued

| | Formulation of mixed powder for powder metallurgy | | | | | | | | Evaluation result | | |
|---|---|---|---|---|---|---|---|---|---|---|---|
| | (a) Iron-based powder | | (b) Alloyed steel powder | | | (c) Cu powder | (d) Graphite powder | (e) Lubricant | Density of | Tensile strength of | |
| No. | Type | Additon amount *1 (mass %) | Type | Additon amount *1 (mass %) | Ratio of Mo *1 (mass %) | Additon amount *2 (mass %) | Additon amount *2 (mass %) | Additon amount *2 (mass %) | formed body ($Mg/m^3$) | sintered body (MPa) | Category |
| 56 | | 50 | b-85 | 50 | 1.91 | 2.0 | 0.7 | 0.5 | 7.12 | 615 | Example |
| 57 | | 70 | b-86 | 30 | 2.06 | 2.0 | 0.7 | 0.5 | 7.17 | 498 | Comparative Example |

*1: Ratio to the total of (a) iron-based powder and (b) alloyed steel powder.

*2: Ratio to the total of (a) iron-based powder, (b) alloyed steel powder, (c) Cu powder, and (d) graphite powder.

The invention claimed is:

1. A mixed powder for powder metallurgy comprising:

(a) an iron-based powder containing Si in an amount of 0 mass % to 0.2 mass % and Mn in an amount of 0 mass % to 0.4 mass %, with the balance being Fe and inevitable impurities; and (b) an alloyed steel powder consisting of Mo in an amount of 0.3 mass % to 4.5 mass %, Si in an amount of 0 mass % to 0.2 mass %, and Mn in an amount of 0 mass % to 0.4 mass %, with the balance being Fe and inevitable impurities, wherein the alloyed steel powder is a pre-alloyed steel powder containing all of the Mo as an alloying element, a ratio of (b) the alloyed steel powder to a total of (a) the iron-based powder and (b) the alloyed steel powder is from 50 mass % to 90 mass %, and a ratio of Mo to the total of (a) the iron-based powder and (b) the alloyed steel powder is 0.20 mass % or more and less than 2.20 mass %.

2. The mixed powder for powder metallurgy according to claim 1, wherein the ratio of (b) the alloyed steel powder to the total of (a) the iron-based powder and (b) the alloyed steel powder is from 70 mass % to 90 mass %.

3. The mixed powder for powder metallurgy according to claim 1, further comprising:

(c) a Cu powder; and (d) a graphite powder, wherein a ratio of (c) the Cu powder to a total of (a) the iron-based powder, (b) the alloyed steel powder, (c) the Cu powder, and (d) the graphite powder is from 0.5 mass % to 4.0 mass %, and a ratio of (d) the graphite powder to the total of (a) the iron-based powder, (b) the alloyed steel powder, (c) the Cu powder, and (d) the graphite powder is from 0.2 mass % to 1.0 mass %.

4. The mixed powder for powder metallurgy according to claim 3, further comprising:

(e) a lubricant, wherein a ratio of (e) the lubricant to the total of (a) the iron-based powder, (b) the alloyed steel powder, (c) the Cu powder, and (d) the graphite powder is from 0.2 mass % to 1.5 mass %.

5. A sintered body obtainable by forming and sintering the mixed powder for powder metallurgy as recited in claim 1.

6. A method for producing a sintered body, comprising subjecting the mixed powder for powder metallurgy as recited in claim 1 to forming and sintering to obtain a sintered body.

7. The mixed powder for powder metallurgy according to claim 2, further comprising:

(c) a Cu powder; and (d) a graphite powder, wherein a ratio of (c) the Cu powder to a total of (a) the iron-based powder, (b) the alloyed steel powder, (c) the Cu powder, and (d) the graphite powder is from 0.5 mass % to 4.0 mass %, and a ratio of (d) the graphite powder to the total of (a) the iron-based powder, (b) the alloyed steel powder, (c) the Cu powder, and (d) the graphite powder is from 0.2 mass % to 1.0 mass %.

8. The mixed powder for powder metallurgy according to claim 7, further comprising:

(e) a lubricant, wherein a ratio of (e) the lubricant to the total of (a) the iron-based powder, (b) the alloyed steel powder, (c) the Cu powder, and (d) the graphite powder is from 0.2 mass % to 1.5 mass %.

9. A sintered body obtainable by forming and sintering the mixed powder for powder metallurgy as recited in claim 2.

10. A sintered body obtainable by forming and sintering the mixed powder for powder metallurgy as recited in claim 3.

11. A sintered body obtainable by forming and sintering the mixed powder for powder metallurgy as recited in claim 4.

12. A sintered body obtainable by forming and sintering the mixed powder for powder metallurgy as recited in claim 7.

13. A sintered body obtainable by forming and sintering the mixed powder for powder metallurgy as recited in claim 8.

14. A method for producing a sintered body, comprising subjecting the mixed powder for powder metallurgy as recited in claim 2 to forming and sintering to obtain a sintered body.

15. A method for producing a sintered body, comprising subjecting the mixed powder for powder metallurgy as recited in claim 3 to forming and sintering to obtain a sintered body.

16. A method for producing a sintered body, comprising subjecting the mixed powder for powder metallurgy as recited in claim 4 to forming and sintering to obtain a sintered body.

17. A method for producing a sintered body, comprising subjecting the mixed powder for powder metallurgy as recited in claim 7 to forming and sintering to obtain a sintered body.

18. A method for producing a sintered body, comprising subjecting the mixed powder for powder metallurgy as recited in claim 8 to forming and sintering to obtain a sintered body.

19. The mixed powder for powder metallurgy according to claim 1, wherein the alloyed steel powder is a pre-alloyed steel powder in which alloying elements are completely alloyed.

* * * * *